United States Patent [19]

Watanabe

[11] Patent Number: 4,798,490

[45] Date of Patent: Jan. 17, 1989

[54] METHOD FOR USING AND REUSING CORRECTION TAPE ASSEMBLY

[75] Inventor: Hiroaki Watanabe, Yokohama, Japan

[73] Assignee: Fuji Kagokushi Kogyo Co., Osaka, Japan; a part interest

[21] Appl. No.: 57,286

[22] Filed: Jun. 2, 1987

Related U.S. Application Data

[63] Continuation of Ser. No. 922,160, Oct. 23, 1986, abandoned, which is a continuation of Ser. No. 685,326, Dec. 24, 1984, abandoned.

[30] Foreign Application Priority Data

Dec. 28, 1983 [JP] Japan ..... 58-203223

[51] Int. Cl.[4] ..... B41J 29/36

[52] U.S. Cl. ..... 400/697.1; 400/223; 400/242

[58] Field of Search ..... 400/207, 219, 223, 242, 400/243, 244, 245, 246, 696, 697.1

[56] References Cited

U.S. PATENT DOCUMENTS

| | | | |
|---|---|---|---|
| 609,476 | 8/1898 | Stickney | 400/219 |
| 1,379,408 | 5/1921 | Holden | 400/242 X |
| 1,575,499 | 3/1926 | Petermann | 400/244 X |
| 1,713,277 | 5/1929 | Goldberg et al. | 400/242 X |
| 2,203,168 | 6/1940 | Long | 400/223 X |
| 2,232,461 | 2/1941 | Kuckhoff | 400/242 X |
| 2,278,009 | 3/1942 | Handley | 400/223 X |
| 2,667,257 | 1/1954 | Hurtado S. | 400/242 |
| 2,853,175 | 9/1958 | Regentrop et al. | 400/242 |
| 2,873,014 | 2/1959 | Lambert | 400/242 X |
| 2,881,003 | 4/1959 | Drew | 273/1.5 R |
| 2,902,136 | 9/1959 | Whippo | 400/242 X |
| 2,986,395 | 5/1961 | Sheftel | 273/1.5 R |
| 3,385,416 | 5/1968 | Frechette | 400/242 X |
| 3,409,114 | 11/1968 | Okuda | 400/242 X |
| 3,427,025 | 2/1969 | Proctor | 273/1.5 R |
| 3,722,886 | 3/1973 | Sinner | 273/1.5 R |
| 3,724,633 | 4/1973 | Korb et al. | 400/697.1 X |
| 3,807,543 | 4/1974 | Robinson et al. | 400/242 |
| 3,807,544 | 4/1974 | Glover | 400/243 |
| 3,819,027 | 6/1974 | Landgraf | 400/243 |
| 3,997,046 | 12/1976 | Wolowitz | 400/697.1 X |
| 4,010,839 | 3/1977 | Guerrini et al. | 400/207 |
| 4,265,553 | 5/1981 | Hatsell | 400/697.1 X |
| 4,330,101 | 5/1982 | Andersen | 273/1.5 R X |
| 4,340,313 | 7/1982 | Bishop | 400/242 X |
| 4,395,040 | 7/1983 | White | 273/1.5 R |
| 4,407,498 | 10/1983 | Clore et al. | 273/1.5 R |
| 4,465,277 | 8/1984 | Dittrich | 273/1.5 R X |
| 4,472,073 | 9/1984 | Valle et al. | 400/691.1 X |
| 4,651,943 | 3/1987 | Kawaguchi | 400/242 X |

FOREIGN PATENT DOCUMENTS

| | | | |
|---|---|---|---|
| 681631 | 10/1966 | Belgium | 273/1.5 R |
| 0141653 | 5/1980 | Fed. Rep. of Germany | 400/244 |
| 3314581 | 10/1984 | Fed. Rep. of Germany | 400/242 |
| 6413102 | 5/1966 | Netherlands | 273/1.5 R |
| 2130146 | 5/1984 | United Kingdom | 400/242 |

OTHER PUBLICATIONS

IBM Technical Disclosure Bulletin, "Ribbon Spool Construction", Goff, Jr., vol. 8 , No. 11, Apr. 1966, p. 1624.

*Primary Examiner*—Ernest T. Wright, Jr.
*Attorney, Agent, or Firm*—Perman & Green

[57] ABSTRACT

A method for using and reusing an invertible correction tape assembly on a typewriter, the assembly comprising a dispensing reel and a winding reel united by a length of correction tape wound upon each. The assembly is designed for invertible attachment to typewriters having correction tape reel-attaching support shaft members, each having a base flange, a first locking pawl and a second locking pawl, so that the assembly can be mounted in both normal and inverted positions. In both positions the dispensing and winding reels are mounted on the base flange, engaged at the lower side by the first locking pawl at the upper side by the second locking pawl. After the correction ribbon is fully dispensed, the assembly is removed, inverted and reattached to redispense the correction ribbon for reuse as many times as permitted by its effectiveness.

3 Claims, 3 Drawing Sheets

A
13
13
28
9
27
12
30
6
5
2
29
9
11
25
24
26
L
21
10
23
7
26
22
31
4
28
9
27
12
30
6
5
2
29
1
9
11
25
24
26
3
20
10
23
7
10
26
31
2
2

METHOD FOR USING AND REUSING CORRECTION TAPE ASSEMBLY

This is a continuation of co-pending application Ser. No. 922,160 filed on Oct. 23, 1986, now abandoned, which was a continuation of application Ser. No. 685,326 filed Dec. 24, 1984, now abandoned.

BACKGROUND OF THE INVENTION

The present invention relates to an assembly including a pair of reels for dispensing and winding a correction tape for a typewriter one or more times. More particularly, it relates to a reel assembly adapted to be removably attached to a correction tape reel attaching structure of a typewriter, which structure has a support shaft member on a correction tape dispensing side and a support shaft member on a correction tape winding side, the support shaft members being rotatably supported on the attaching block of the typewriter, and the support shaft members being of substantially the same shape and size and each comprising a base flange, a middle shaft erected on the base flange, and a first locking pawl, the middle shaft being integrally provided with a tongue-like spring provided with a second locking pawl on the outer surface of the free end thereof.

A correction tape for this kind of typewriter will have ink stuck to its, lift-off surface when used only once, in which case it has been considered to be no longer suitable for further use. However, when the correction tape used once and wound on a winding reel was unwound nd used again, it was found that the tape still retained its lift-off function to the extent that it was suitable for reuse there.

However, even though such correction tape is reusable, the dispensing and winding structure is originally designed to be suited to single use of the tape, and therefore it is required that the tape, when used once, be manually unwound from the winding reel and wound on the dispensing reel for reuse, which operation is very troublesome and has discouraged the typist from reusing the tape.

It is an object of the present invention to provide a reel assembly for dispensing and winding a correction tape for a typewriter by which the correction tape can be reused without the manual re-reeling of the used correction tape on another reel.

Another object of the present invention is to provide a reel assembly for dispensing and winding a correction tape for a typewriter wherein only a simple change in the reel is made to reuse the correction tape and no change in the structure associated with the typewriter having the known correction tape driving mechanism is required.

These and other objects of the present invention will become apparent from the description hereinafter.

SUMMARY OF THE INVENTION

In accordance with the present invention, there is provided an assembly for dispensing and winding a correction tape for a typewriter which is adapted to be removably attached to a correction tape reel attaching structure of the typewriter, the structure having a support shaft member on a correction tape dispensing side and a support shaft member on a correction tape winding side, the support shaft members being rotatably supported on an attaching block of the typewriter, and the support shaft members being of substantially the same shape and size and each comprising a base flange, a middle shaft erected on the base flange, and a first locking pawl, the middle shaft being integrally provided with a tongue-like spring provided with a second locking pawl on the outer surface of the free end thereof, which comprises a correction tape dispensing reel and a correction tape winding reel, each of the dispensing and winding reels being centrally formed with a double-sleeve-like boss section, the inner sleeve of the boss section being fitted on the middle shaft of the support shaft member, the inner and outer sleeves of the boss section defining therebetween a spacing adapted to have the first locking pawl fitted therein, each end of the inner sleeve being formed with an engagement portion adapted to engage the second locking pawl, and the distance along the rotation axis of each reel between the one end surface of each reel that abuts against the base flange and the one engagement portion of the inner sleeve that engages the second locking pawl, when each reel is in normal position, being substantially the same as the distance along the rotation axis of each reel between the other end surface of each reel that abuts against the base flange and the other engagement portion of the inner sleeve that engages the second locking pawl, when each reel is in inverted position.

BRIEF DESCRIPTION OF THE INVENTION

DETAILED DESCRIPTION

Figure 1:
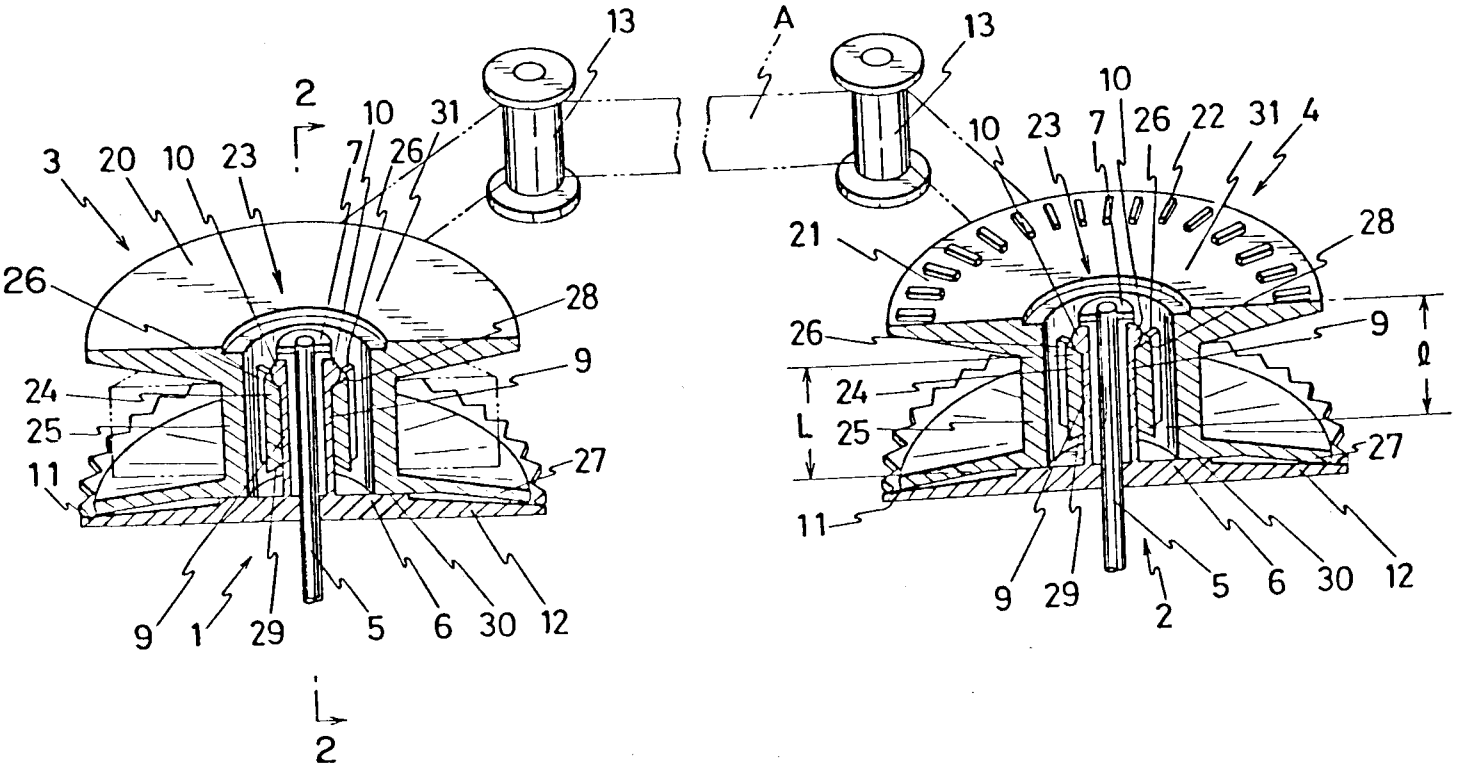
FIG. 1 is a perspective view, in longitudinal section, of a reel assembly according to an embodiment of the present invention, showing its mounted state in use.

To achieve the above-mentioned object, the present invention has improved the boss section of a conventional reel used in combination with the correction tape reel attaching structure of the above-specified typewriter.

That is, the opposite ends of the inner sleeve of the boss section are each formed with an engagement portion for engagement with the second locking pawl, and the distance along the rotation axis of the reel between the one end surface of the reel that abuts against the base flange and the one engagement portion of the inner sleeve that engages the second locking pawl, when the reel is attached to the support shaft member in normal position, is substantially the same as the distance along the rotation axis of the reel between the other end surface of the reel that abuts against the base flange and the other engagement portion of the inner sleeve that engages the second locking pawl, when the reel is inverted.

This arrangement ensures that even if the reel is turned upside down, it can be mounted on either of the two support shaft members and can be subjected to the slip-off preventing action provided by the second locking pawl.

As a result, the reel initially used for winding the correction tape is removed from the support shaft member on the correction tape winding side, turned upside down and reattached to the support shaft member on the correction tape dispensing side, while the reel used for dispensing the correction tape is removed from the support shaft member on the correction tape dispensing side, turned upside down and reattached to the support shaft member on the correction tape winding side, to thereby enable the correction tape to be moved in the reverse direction. Thus, the present invention has made possible the repeated use of the correction tape by simply inverting and transposing the two reels.

Further, the modification required for obtaining such function and effect is only to make a slight change in the inner sleeve of the boss section of the reel, which means that the function of enabling the reuse of the correction tape according to the present invention can be made possible in simple manner on any conventional, commercially available typewriter that has the aforesaid construction.

The present invention will now be more particularly described with reference to the accompanying drawings. These embodiments shown in the drawings are intended to illustrate the invention and not be construed to limit the scope of the invention. It is to be understood that various changes and modifications may be made in the invention without departing from the spirit and scope thereof.

Figure 2:
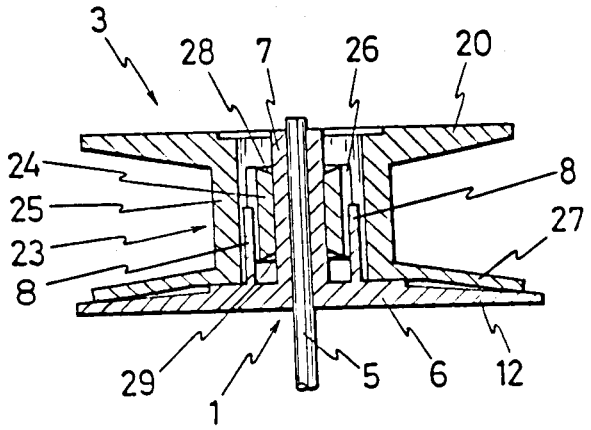
FIG. 2 is a longitudinal section of a reel shown in FIG. 1, taken along the line 2—2.
Figure 3:
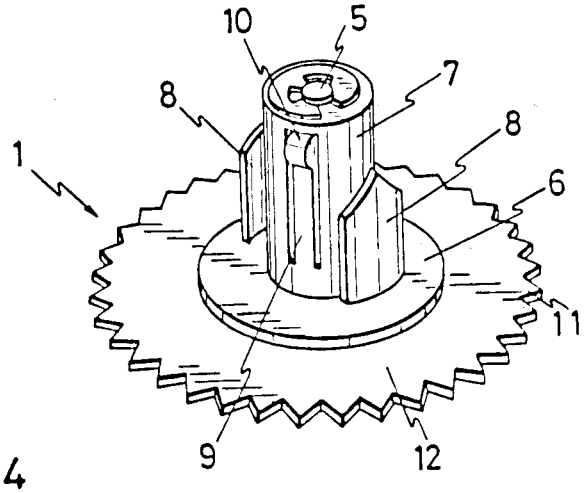
FIG. 3 is a perspective view of a support shaft member shown in FIG. 1.

Referring to FIGS. 1, 2 and 3, there is illustrated an embodiment of the reel assembly of the present invention (hereinafter referred to as "Embodiment 1").

In FIGS. 1, 2 and 3, the numeral 1 denotes a support shaft member on a correction tape dispensing side, and the numeral 2 denotes a support shaft member on a correction tape winding side. Since the two support shaft members 1 and 2 are the same in the arrangement concerning the mounting of their respective reels 3 and 4, common reference numerals are used in the figures and the arrangement of one support shaft member will be described to serve as a description of the other, unless noted otherwise.

The numeral 5 denotes a central shaft of the typewriter mechanism, which stands vertically. The support shaft member 1 is attached to the central shaft 5. The support shaft member 1 is usually made of a plastic material.

The support shaft member 1 comprises a base flange 6, a middle shaft 7 extending vertically from the upper surface of the base flange 6, two first locking pawls 8 which extend from the base flange 6 along the middle shaft 7 on the opposite sides of the middle shaft 7, two tongue-like springs 9 integrally formed in the middle shaft 7 and which extend along the axis of the middle shaft 7 on the opposite sides of the side wall of the middle shaft 7, a second locking pawl 10 integrally provided on the outer surface of the free end of each spring 9, and a gear 12 integrally extended from the base flange 6 and having sawteeth 11 on its peripheral edge.

The reels 3 and 4 will now be described.

The dispensing and winding reels 3 and 4 differ from each other only in whether or not gear-like finger catch projections 22 are formed on the upper surface of the upper flange 20 or 21, the rest of the arrangement being the same. Thus, only one of the reels 3 will be described, while the same numerals are applied to the other reel 4 to replace a description thereof, unless noted otherwise.

The numeral 23 denotes the boss section of the reel 3, which comprises an inner sleeve 24 mounted on the middle shaft 7 mentioned above, and an outer sleeve 25, the two sleeves 24,25 being integrated together by a plurality of ribs 26, for instance, four ribs. The outer sleeve 25 has upper and lower flanges 20 and 27 integrally extending from its upper and lower ends. The two sleeves 24, 25 and the ribs 26 define therebetween a spacing adapted to have the first locking pawls 8 fitted therein.

The upper and lower ends of the inner sleeve 24 are in the form of inwardly inclined taper surfaces which provide engagement portions 28 and 29 associated with the second pawl 10. The distance L along the rotation axis of the reel 3 between the upper engagement portion 28 and the abutment surface 30 of the lower flange 27 against the base flange 6 is equal to the distance l along the rotation axis of the reel 3 between the lower engagement portion 29 and the abutment surface 31 of the upper flange 21 against the base flange 6, when the reel 3 is inverted, so that the reel 3 can be installed in any one of the two support shaft members 1 and 2 in its inverted or normal position and slip-off prevention by the engagement of the second locking pawl 10 can be attained.

In the reel assembly of such arrangement, after a lift-off tape A initially wound on the dispensing reel 3 has been dispensed through guide pins 13 and wound on the winding reel 4 as it is used, the two reels 3 and 4 removed from the support shaft members 1 and 2 and then inverted, the winding reel 4 being mounted on the dispensing support shaft member 1 and the dispensing reel 3 being mounted on the winding support shaft member 2. Thus, the two reels 3 and 4 are prevented by the two types of locking pawls 8 and 10 from relative rotation against the respective support shaft member 1 and 2 and from accidental slip-off, so that the lift-off tape A can be used while being unwound.

In addition, where the dispensing reel 3 is shaped to have an inverted form of the winding reel 4, the finger catch gear like projections 22 will be always present on the upper surface of the reel 4 on the winding side when the lift-off tape A is repeatedly used and thus, the effect of the projections 22, i.e., the ease for initial manual winding will be always developed.

Figure 4:
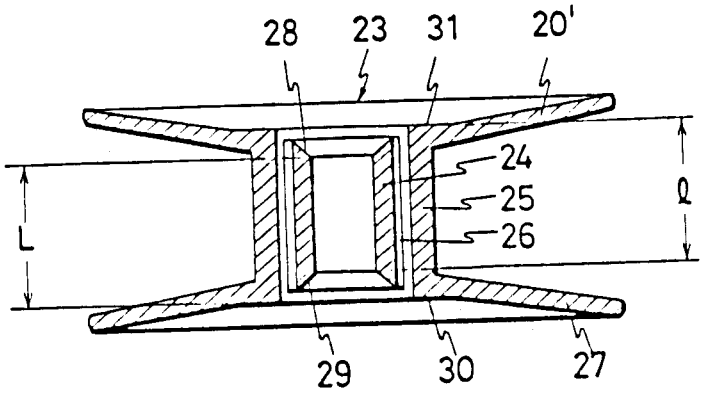
FIG. 4 is a longitudinal section of a reel according to another embodiment of the invention.

Referring to FIG. 4, there is illustrated a second embodiment of the reel assembly of the present invention (hereinafter referred to as "Embodiment 2").

This embodiment illustrates another form of reel, wherein the reel is vertically symmetrically formed. That is, an upper flange 20' which has the same shape as that of the lower flange 27 in the reel shown in Embodiment 1 is provided. The rest of the arrangement is the same as in Embodiment described above, and hence the same numerals as in FIGS. 1 to 3 are applied thereto and a detailed description thereof is omitted.

Figure 5:
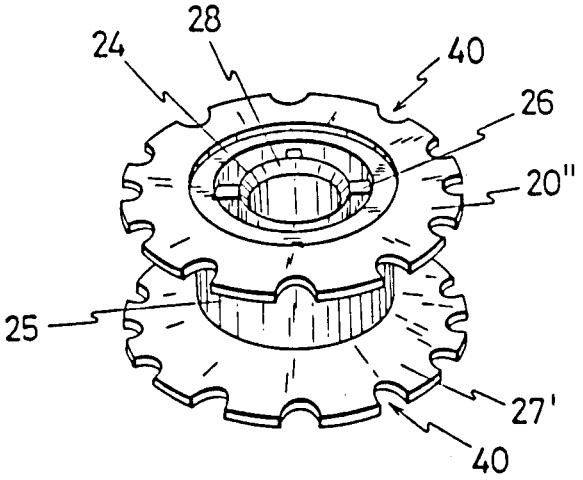
FIG. 5 is a perspective view showing a reel according to still another embodiment of the invention.

Referring to FIG. 5, there is illustrated a third embodiment of the reel assembly of the present invention (hereinafter referred to as "Embodiment 3").

This embodiment illustrates still another form of reel which is an improvement over the reel of Embodiment 2. That is, the peripheral edges of the upper and lower flange 20' and 27' are formed with equispaced cuts 40 to provide the same function as that of the gear-like projections 22 shown in Embodiment 1. The rest of the arrangement is the same as in Embodiment 2 and hence the same numerals as in FIG. 4 are applied thereto and a detailed description thereof is omitted.

Figure 6:
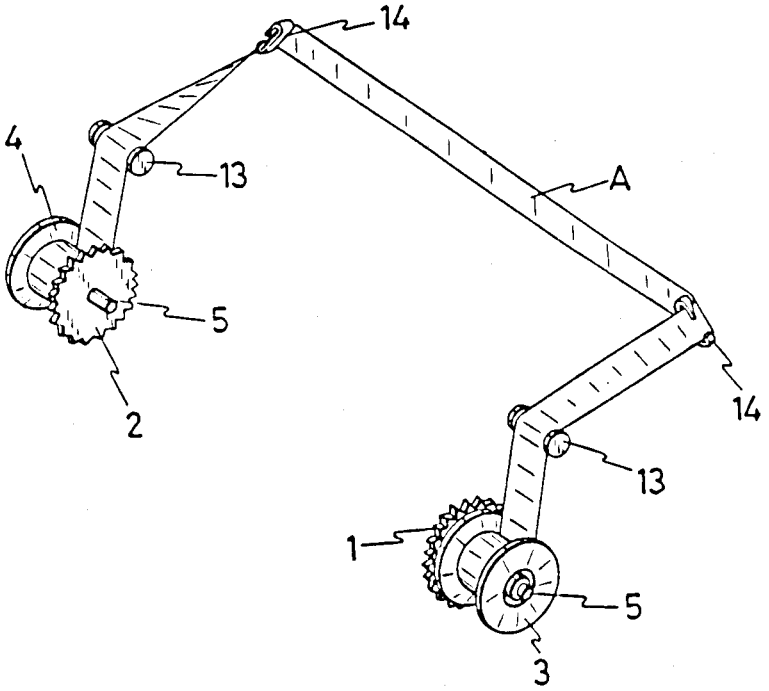
FIG. 6 is a perspective view of another mounted state of the reel assembly shown in FIG. 1 in use.

Referring to FIG. 6, there is illustrated another mounted state of the reel assembly of the present invention in use. In this embodiment, two central shafts 5, 5 of the typewriter mechanism extend horizontally. The support shaft member 1 and the reel 3 on the correction tape dispensing side and the support shaft member 2 and the reel 4 on the correction tape winding side are attached to the central shafts 5, 5, respectively. The numeral 14 denotes a guide arm for changing the tape direction.

In addition to the elements used in the Examples, other elements can be used in the Examples as set forth in the specification to obtain substantially the same results.

What is claimed is:

1. A method for dispensing and winding a correction tape in a typewriter equipped with a first support shaft member on a tape-dispensing side and second support shaft member on a tape-winding side for the correction tape, said first and second support shaft members being of substantially the same shape and size, the method comprising the steps of:

(1) mounting a first reel containing a full length of wound correction tape on said first support shaft member so that the first reel is rotatable therewith and prevented from accidental slip-off from said first support shaft member;

(2) mounting a second, empty reel which is designed to receive said length of the correction tape on said second support shaft member so that the second reel is rotatable therewith and prevented from accidental slip-off from said second support shaft member, each of said first and second reels having a boss section, said boss section having a first means for preventing a relative rotation between each reel and each support shaft member in cooperation with a first locking pawl (8) erected on a base flange (6) of each support shaft member whether each reel is in normal position or in inverted position; and a second means for frictionally engaging and preventing accidentally slip-off of each reel from each support shaft member in cooperation with a second locking pawl (10) connected to said base flange, said second locking pawl resiliently engaging said second means at the same height above said base flange whether each reel is in normal position or in inverted position, the boss section (23) of each reel comprising an inner sleeve (24) and an outer sleeve (25) integrated together by ribs, the inner sleeve being shorter than the outer sleeve, said outer sleeve having an upper flange (20) and a lower flange (27) which extend integrally from the upper and lower ends thereof, respectively, said outer and inner sleeves and ribs defining therebetween a space which extends through said upper and lower flanges to receive said first locking pawl through either flange, said defined spaced being said first means, the upper and lower ends of said inner sleeve providing engaging portions which are in the form of inwardly inclined tapered surfaces, respectively, said engaging portions being said second means, said first means being engaged with said first locking pawl and said second means being engaged with said second locking pawl when said first and second reels are mounted on said first and second support shaft members;

(3) dispensing the correction tape from said first reel and winding said tape up on said second reel until said second reel contains the full length of the correction tape;

(4) forcing said first reel and said second reel to be detached from said first support shaft member and said second support shaft member, respectively;

(5) inverting said second reel, containing the full length of the correction tape, and mounting the inverted second reel on said first support shaft member so that the second reel is rotatable therewith and prevented from accidental slip-off from said first support shaft member;

(6) inverting said first reel which is empty and mounting the inverted first reel on said second support shaft member so that the first reel is rotatable therewith sand prevented from accidentally slip-off from said second support shaft member;

(7) dispensing the correction tape from said second reel and winding said tape up on said first reel until said first reel again contains the full length of the correction tape; and (8) repeating the procedures of steps (1) to (7) as many times as permitted by the effectiveness of said correction tape.

2. The method of claim 1, wherein each of said first and second support shaft members has a hollow middle shaft (7) erected on the central part of the base flange and through which a central shaft (5) of the typewriter is inserted for supporting the support shaft member, said second locking pawl (10) being integrally formed on the outer surface of the free end of as tongue-like spring (9) integrally formed in said middle shaft.

3. The method of claim 1 in which the upper and lower ends of the inner sleeve are recessed relative to the upper and lower ends of the outer sleeve whereby said engaging portions of the inner sleeve are recessed below the uppermost flange of the outer sleeve in engaged position.

* * * * *